US005755044A

United States Patent [19]

Veylupek

[11] Patent Number: 5,755,044

[45] Date of Patent: May 26, 1998

[54] SHOE LACING SYSTEM

[76] Inventor: Robert J. Veylupek, 5250 S. Huron Way, Bldg. 13, Unit 312, Littleton, Colo. 80120

[21] Appl. No.: 582,894

[22] Filed: Jan. 4, 1996

[51] Int. Cl.[6] ..... A43C 11/00

[52] U.S. Cl. ..... 36/501

[58] Field of Search ..... 36/50.1; 24/713.6, 24/713.8, 713.9, 714.6, 129 B, 129 R

[56] References Cited

U.S. PATENT DOCUMENTS

| | | | |
|---|---|---|---|
| 3,703,775 | 11/1972 | Gatti . | |
| 3,710,486 | 1/1973 | Revny . | |
| 4,640,025 | 2/1987 | DeRenzo . | |
| 5,016,327 | 5/1991 | Klausner . | |
| 5,027,482 | 7/1991 | Torppey . | |
| 5,074,013 | 12/1991 | Arnold et al. . | |
| 5,158,428 | 10/1992 | Gessner et al. . | |
| 5,319,869 | 6/1994 | McDonald et al. . | |
| 5,345,697 | 9/1994 | Quellais | 36/50.1 |
| 5,349,764 | 9/1994 | Posner . | |
| 5,353,483 | 10/1994 | Louviere | 36/50.1 |
| 5,357,691 | 10/1994 | Hyde et al. . | |
| 5,537,763 | 7/1996 | Donnadieu et al. | 36/50.1 |

*Primary Examiner*—Paul T. Sewell
*Assistant Examiner*—Anthony Stashick
*Attorney, Agent, or Firm*—Quirk & Tratos

[57] ABSTRACT

A shoe lacing system comprises a lace, anchor elements, and a mechanism for releasably attaching the ends of the lace to the shoe. The anchor elements comprise guides having a first portion for attachment to an existing eyelet of the shoe, and a second portion through which and with respect to which the lace may move. The lace comprises a double-strand of material having a low friction outer surface. A middle portion of the lace is routed through and between the anchor elements located on opposite sides of a tongue of the shoe. The ends of the lace extend from the anchor elements near a top of the tongue along opposite sides of the shoe to the rear of the shoe. Each lace is connected to a tab having a section of hook or loop material designed for engagement with a mating section of material on the rear of the shoe.

18 Claims, 6 Drawing Sheets

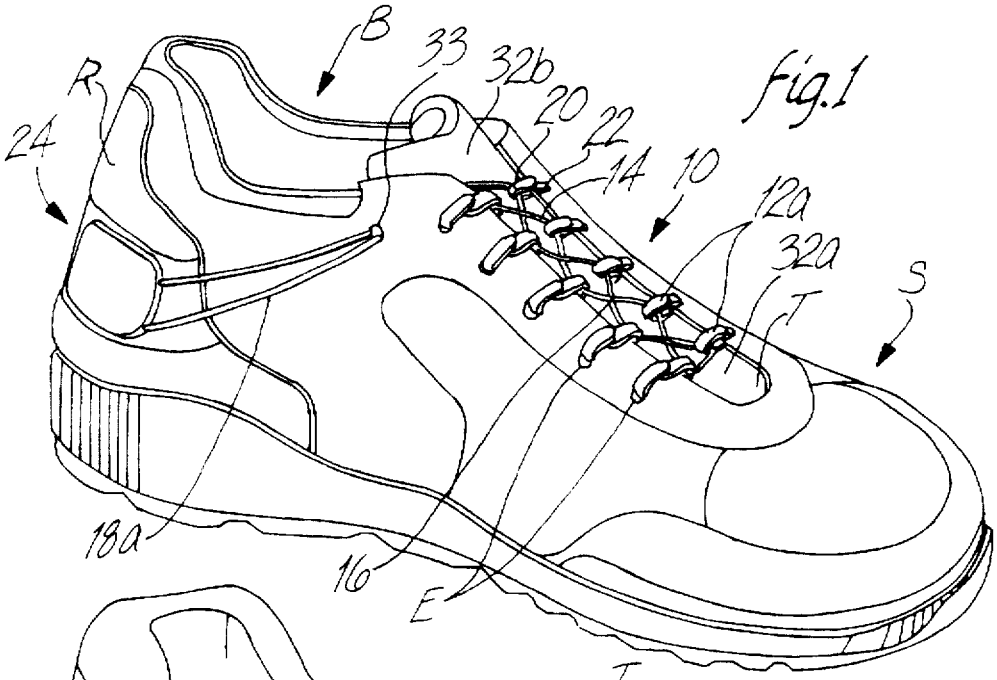
fig.1
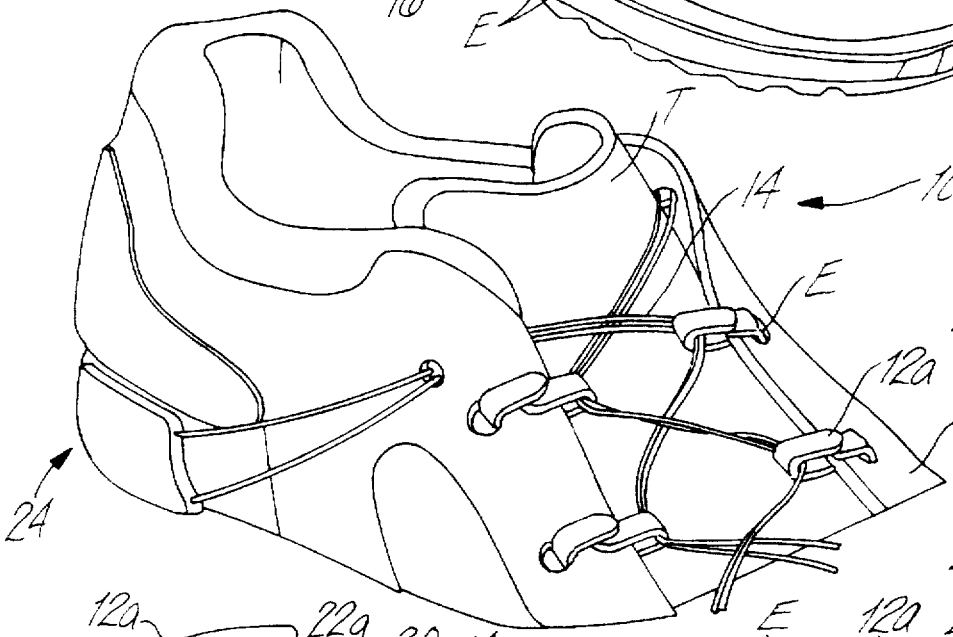
fig.2
fig.5
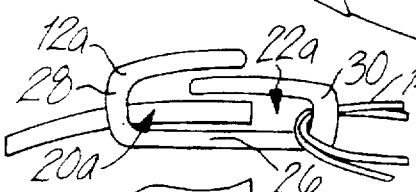
fig.3
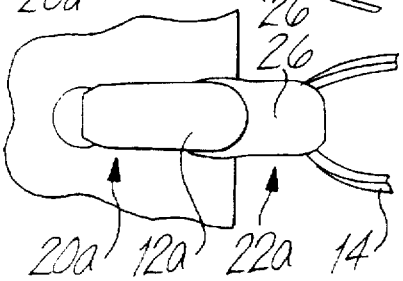
fig.4
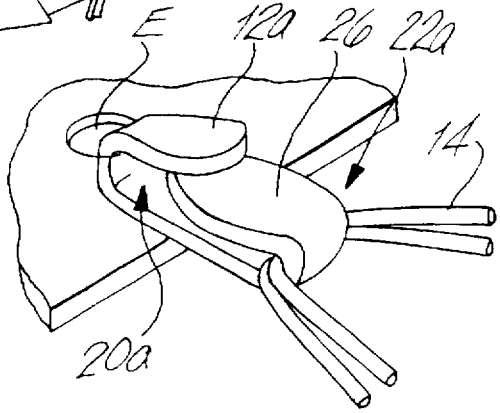

SHOE LACING SYSTEM

FIELD OF THE INVENTION

The present invention generally relates to shoes and, more particularly, to a shoe lacing system for securing the upper body of a shoe over a wearer's foot.

BACKGROUND OF THE INVENTION

Traditionally, a wearer secures a shoe over his foot by means of a lace which is threaded in a criss-cross fashion between lace eyelets in the body of the shoe. The eyelets are arranged in parallel rows on opposite sides of the body of the shoe separated by a central slit overlying a tongue of the shoe. The wearer pulls on free ends of the lace, which in turn pulls the rows of lace eyelets toward one another, thereby securing the upper body of the shoe tightly over the wearer's foot.

Often, friction between the lace and the eyelets prevents the wearer from pulling the lace throughout its length, so that the lace is not evenly tightened along its length. In order to achieve a more secure fit, the wearer must often adjust individual sections of the lace extending between pairs of opposing eyelets.

Once the wearer properly tightens the lace, the wearer ties the opposite ends of the lace together in a knot to prevent loosening of the lace, which would otherwise allow the rows of lace eyelets to move away from one another. This process takes time, and in sports such as triathlons and duathlons where competitors change shoes during the race, the time it takes to secure a pair of shoes as described above represents a significant disadvantage.

Shoe lacing arrangements have been proposed in the prior art that are modifications of the above-described traditional arrangement for securing the upper body of a shoe over a wearer's foot. In these arrangements, the lace is typically routed in the traditional criss-cross manner between eyelets, but then after tightening of the lace, the free ends thereof are secured to the upper body of the shoe without the need for tying a knot. Examples of such arrangements are disclosed in U.S. Pat. No. 5,158,428 to Gessner et al. and U.S. Pat. No. 5,349,764 to Posner.

The Gessner et al. patent discloses a shoe lacing arrangement in which a clamp is provided on the upper body of the shoe through which the end of a lace may be routed. The lace may be pulled lengthwise through the clamp in one direction, but when pulled lengthwise in the opposite direction, angled grooves on the sides of the channel direct the lace towards the center of the clamp where it is further locked and retained. Thus, the free ends of a lace may be routed through a pair of these clamps secured to opposite sides of a shoe rather than tying the ends of the lace together.

The Posner patent discloses a shoe lacing arrangement in which a preformed channel is formed on both sides of the ankle portion of a shoe. On both sides of the channel, there is a diagonal groove which extends around the back of the shoe to a horizontal groove on the opposite side. A first portion of a fastening material, such as hook or loop material, is disposed in the horizontal groove. After tightening of the lace, its free ends are threaded through opposite guides, run along respective diagonal grooves around the back of the shoe and into the horizontal grooves where mating ends of the lace having complementary second portions of the fastening material are fastened to the first portion of the fastening material to secure the shoe to the wearer's foot without the need for tying a knot.

While both the Gessner et al. and Posner shoe lacing arrangements eliminate the need for tying the free ends of the lace together, they fail to address the time-consuming task of properly tightening the lace.

SUMMARY OF THE INVENTION

The present invention is a shoe lacing system designed to satisfy the aforementioned needs by avoiding the drawbacks of the prior art without introducing other drawbacks. The lacing system of the present invention preferably comprises: (a) a plurality of anchor elements configured for mounting to the eyelets of a shoe; (b) a lace in the form of at least one elongate inelastic flexible element having a low friction outer surface, the lace having a middle section and two ends; and (c) means for releasably fastening or engaging the ends of the lace to a rear end of the shoe.

The lace comprises a flexible, elongate element of strong material having at least an exterior surface which has a low friction coefficient. Preferably, the lace comprises a section of line or similar material.

The anchor elements may have a variety of configurations. In a first form, the elements each have a first section for engagement with an existing eyelet and a second section for passage of the lace therethrough. In a second form, the anchor elements comprise hollow tubular guides which completely eliminate the need for eyelets. In either case, the anchor elements are mounted on opposite sides of the tongue on the shoe, and are designed for low-friction engagement with the lace, whereby the lace may move freely with respect to each anchor element.

The lace includes a middle section which the wearer routes between the anchor elements. In particular, the wearer preferably laces the shoe in a normal lacing arrangement by routing the lace between the anchors near the front end of the shoe to the elements located near the top of the tongue.

After routing through the anchor elements, the wearer extends the opposite ends of the lace along opposite sides of the shoe to a rear end thereof. Preferably, the laces extend from opposite sides of the inside of the shoe adjacent the tongue through passages in the body of the shoe to the outer surface of the shoe, and then around opposite sides of the shoe to the rear thereof. In another embodiment, the ends of the laces are routed through tubular guides from the tongue area to the rear of the shoe, so as not to be exposed on the outer surface of the shoe.

In a first form, the means for releasably engaging the ends of the lace to the shoe comprises a section of hook or loop material located on the outside surface of the rear of the shoe for engagement with a section of material located on a tab connected to each end of the lace.

In another form, the means for releasably engaging comprises a strap connected to the ends of the laces for engagement with a strip on the shoe. The strap includes a section of hook or loop material for mating engagement with a mating section on the strip. In another form, the means comprises a strap connected to the ends of the laces for engagement with a clamp on the shoe. The strap passes between a clamping arm and base. In a first position, the strap moves freely between the arm and base, and in a second position is secured therebetween.

Use of the lacing system of the present invention is as follows. The wearer or shoe manufacturer mounts the anchor elements on the shoe and routes the lace between them and about the shoe as described above. The wearer releases the tabs connected to the ends of the lace from the section of material on the end of the shoe. The wearer loosens the lace and inserts his foot into the shoe. The wearer then tightens the lace to secure the shoe to his foot.

In order to tighten the lace, the user pulls rearwardly on the tabs connected to the ends of the lace. Because the lace and anchor elements have low-friction exterior surfaces, the lace moves freely with respect to each and every anchor element. In other words, the lace is evenly tightened along its entire length.

Once the lace is sufficiently tight, the wearer secures each tab to the strip located on the rear of the shoe, whereby preventing loosening of the lace.

Further objects, features, and advantages of the present invention over the prior art will become apparent from the detailed description of the drawings which follows, when considered with the attached figures.

DESCRIPTION OF THE DRAWINGS

FIG. 1 is a perspective view of a shoe employing a first embodiment of a shoe lacing system of the present invention;

FIG. 2 is an enlarged partial perspective view of the shoe lacing system of FIG. 1;

FIG. 3 is a side elevational view of a first configuration of an anchor element of the lacing system of the present invention;

FIG. 4 is a top plan view of the first configuration of the anchor element of FIG. 3;

FIG. 5 is a perspective view of the first configuration of the anchor element of FIG. 3;

DETAILED DESCRIPTION OF THE PREFERRED EMBODIMENT

Figure 6:
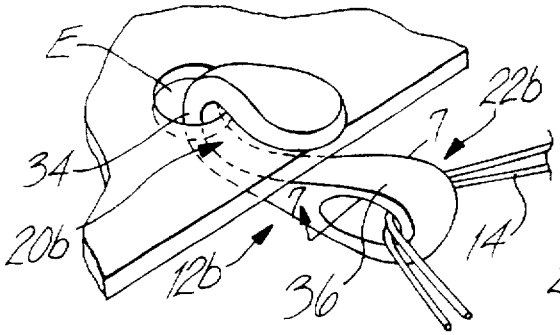
FIG. 6 is a perspective view of a second configuration of the anchor element of the lacing system of the present invention.

Referring to the drawings, and particularly to FIGS. 1 and 2, there is illustrated a first embodiment of a shoe lacing system of the present invention, generally designated 10. The first embodiment of the lacing system 10 shown in FIGS. 1 and 2 is for use with a shoe S having a plurality of lace eyelets E formed in the upper body B of the shoe S and arranged in a pair of rows thereof along respective opposite sides of the tongue T of the shoe S.

Generally, the shoe lacing system 10 includes a plurality of anchor elements 12*a*, an elongated lace 14 and releasable fastening means 24. The anchor elements 12*a* are configured for mounting to the lace eyelets E, thus forming a pair of rows of elements disposed along the rows of the lace eyelets E.

The elongated lace 14 preferably comprises a double strand of durable, strong, flexible and fairly frictionless cord, as described in more detail below. The lace 14 has a middle portion 16 and two end portions 18*a,b*. The middle portion 16 of the lace extends through the first or front row of anchor elements 12*a* located near a front end 32*a* of the tongue T and then in a criss-cross relationship about and between the anchor elements 12*a* upwardly along the body B of the shoe S a rear end 32*b* of the tongue T, and then on to the end portions 18*a,b* located at the rear R of the shoe.

The releasable fastening means 24, described in more detail below, preferably comprises means for releasably fastening the ends 18*a,b* of the lace 14 to a rear end R of the upper body B of the shoe S (see also FIG. 10).

As illustrated, to facilitate the routing of the lace 14 from the rear portion 32*b* of the tongue T around the shoe S to the rear R thereof, a passage 33 is preferably located through the body B of the shoe S. A wearer may thereby route the lace 14 from the row of anchor elements 12*a* located nearest the rear end 32*b* of the tongue T, between the tongue and body B of the shoe S, and out through the passage 33.

As mentioned above, in the first embodiment of the lacing system 10 shown in FIGS. 1 and 2, lace/shoe anchor means are defined in the form of anchor elements 12*a* mounted to the respective lace eyelets E. The anchor elements 12*a* in one row extend from the lace eyelets E toward the anchor elements 12*a* in the other opposite row and partly over the tongue T of the shoe S. The anchor elements 12*a–d* may have a variety of different configurations, some of which are best illustrated in FIGS. 5, 6, 8, and 21.

In all of the different anchor configurations illustrated in FIGS. 5, 6, 8 and 21, each anchor element 12*a–d* is similar in that it comprises an attaching portion 20*a–d* and a guiding portion 22*a–d*. The attaching portion 20*a–d* of each anchor element 12*a–d* is connectable to one of the lace eyelets E. The guiding portion 22*a–d* of each anchor element 12*a–d* is fixedly attached to the attaching portion 20*a–d* such that when the anchor element 12*a–d* is installed, it preferably extends beyond a corresponding one of the respective opposite sides of the tongue T toward the opposite side of the tongue.

The inside surfaces 30 of the guiding portion 22*a–d* of each anchor element 12*a–d* are is designed for smooth passage of the lace 14 therethrough. As such, the inside surfaces 30 of the guiding portion 22*a–d* are curved, smooth, and low friction. The anchor elements 12*a–d*, with respect to all embodiments described hereinafter, are made of a smooth, slippery, or low friction material, such as plastic or metal, for ease of movement of the lace 14 therethrough.

A first configuration of the anchor element 12*a–d* is illustrated in FIGS. 1–5. In this configuration, the anchor element 12*a* is a substantially rigid member 26 preferably made of a high-strength, light-weight plastic or polycarbonate material. The attaching portion 20*a* of the anchor element 12*a* preferably comprises a "U"-shaped first hook 28 formed on one of a pair of opposite ends of the member 26. The guiding portion 22 of the anchor element 12*a* is a second "U"-shaped hook 30 formed on the opposite end of the member 26.

The first hook 28 defines an area for acceptance of a portion of the shoe S, whereby a wearer may engage the first hook 28 with an eyelet E in the shoe. The second hook 30 defines a slot through which the wearer may thread the lace 14.

Figure 7:
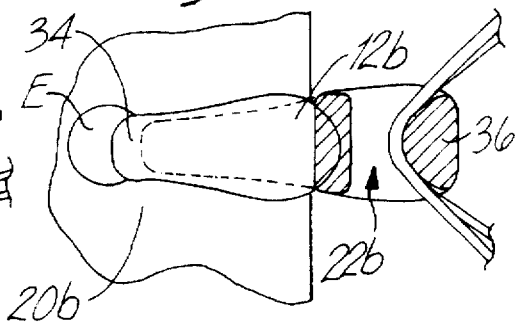
FIG. 7 is a top plan view of the second configuration of the anchor element of FIG. 6 shown in partial cross-section taken at line 7—7.

In a second configuration illustrated in FIGS. 6 and 7, the anchor element 12*b* comprises an member having a hook element 34 as the attaching portion 20*b* and an enclosed loop or eyelet 36 as the guiding portion 22*b*. The hook 34 and eyelet 36 define, respectively, a slot for insertion of the element 12 to an eyelet E of the shoe S and an aperture through which the lace 14 passes. The enclosed eyelet 36 has an interior surface which is smooth and low-friction, allowing the lace 14 to pass easily therethrough.

Figure 8:
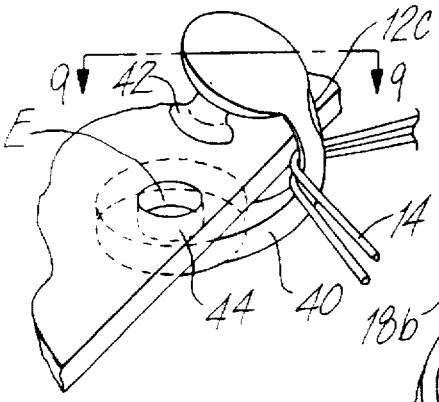
FIG. 8 is a perspective view of a third configuration of the anchor element of the lacing system of the present invention.
Figure 9:
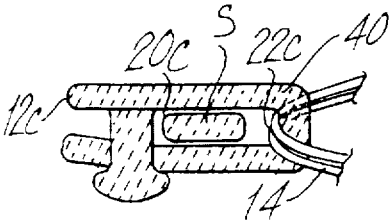
FIG. 9 is a cross-sectional view of the fourth configuration of the anchor element of FIG. 8 shown in cross-section taken at line 9—9.

In a third configuration seen in FIGS. 8 and 9, the anchor element 12*c* is a flexible strip 40 having a ring 42 at a first end and a plug 44 at a second end. The attaching portion 20*c* of the anchor element 12*c* is defined by the interengagement of the projection 42 with the ring 44, while the guide portion 22*c* is defined by the portion of the anchor element 12*c* between its ends. The plug 44 is sized for insertion through an eyelet E and for engagement with the ring 42 of the anchor element 12*c*.

A fourth configuration of anchor elements is illustrated FIGS. 18–21. In this form of the invention, the anchor element 12*d* comprises a loop of relatively stiff, preferably coated, wire having a closed "U"-shaped configuration. The attaching portion 20*d* of the anchor element 12*d* comprises a first pair of U-shaped wire segments 46 formed at a first end of the anchor element 12*d*. The guiding portion 22*d* of the anchor element 12*d* comprises a second pair of "U"-shaped wire segments 48 formed at a second opposite end of the anchor element 12*d*.

Figure 10:
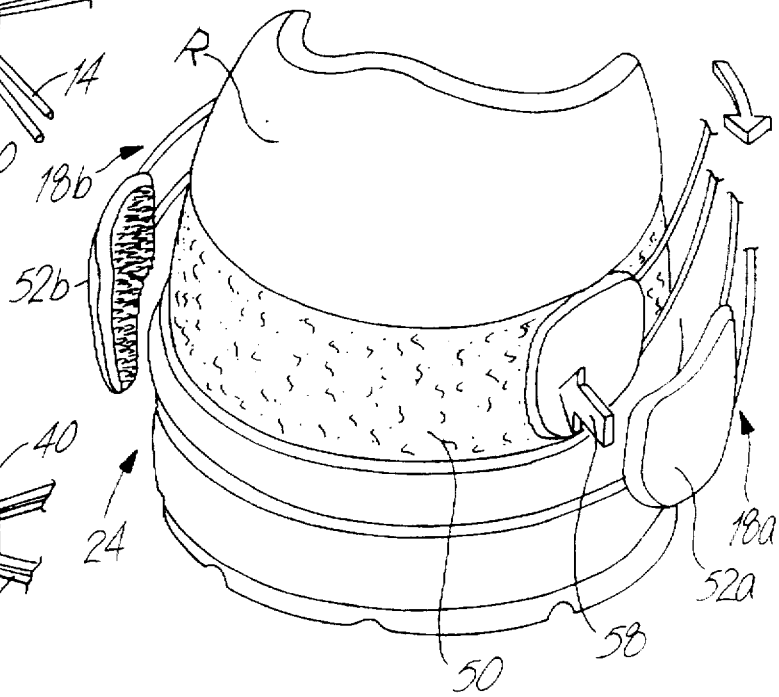
FIG. 10 is a perspective view of a first embodiment of a releasable fastening arrangement of the lacing system of the present invention.

FIGS. 10 through 12 illustrate a first embodiment of the releasable fastening means 24 for use in the shoe lacing system 10. As illustrated in FIGS. 10 and 11, the means 24 preferably comprises a segment 50 of hook or loop fastening material which is secured to the rear end R of the shoe S and a mating pair of releasable fastening tabs 52*a,b* having hook or loop fastening material on an inside surface thereof for engagement with the segment 50 of material on the shoe.

Figure 11A:
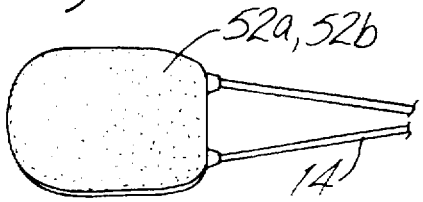
FIG. 11*a* is a top plan view of a first version of a tab of the first embodiment of the releasable fastening arrangement of FIG. 10 having patches of hook or loop fastening material thereon.
Figure 11B:
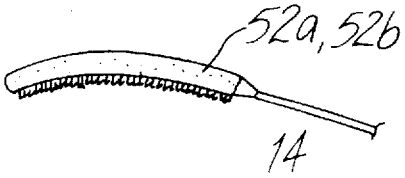
FIG. 11*b* is a side view of the first version of the tab illustrated in FIG. 10.

In a first version, illustrated in FIGS. 10 and 11*a–b*, each tab 52*a,b* is designed for use with a lace 14 comprising two cord members. In this form of the invention, the tabs 52*a,b* are thin, sturdy members having a first outer side for engagement by the fingers of a user and a second, inner side, having hook or loop material located thereon. The lace 14 is coupled at the top and bottom of one of the edges of the tab 52*a,b* as illustrated in FIG. 11*a*.

Figure 12A:
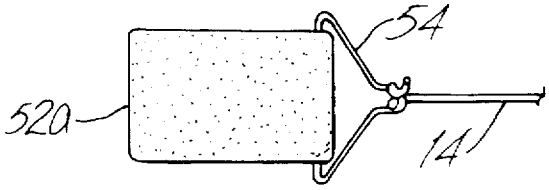
FIG. 12*a* is a top plan view of a second version of the tab of the first embodiment of the releasable fastening arrangement of FIG. 10.
Figure 12B:
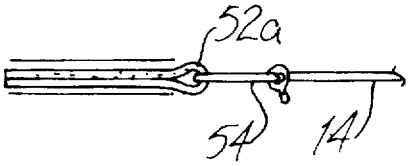
FIG. 12*b* is a side view of the second version of the tab illustrated in FIG. 12.

In a second version, illustrated in FIGS. 12*a–b*, each tab 52*a* comprises a thin, sturdy member looped around a leg of a triangular connecting frame 54. Each tab 52*a* has hook or loop material located on both outwardly facing surfaces. The lace 14 is attached to the triangular connecting frame 54.

Referring to FIGS. 2, 6, and 7, the elongated lace 14 which engages the anchor elements 12*a–d* is formed of at least one and preferably a pair of elongated strings, cords or wires for use in tightening the upper body B of the shoe S about the wearer's foot. The lace 14 is preferably made of a substantially inelastic, flexible material and at least the middle portion 16 thereof has a relatively low friction exterior surface.

As an example, the lace 14 may comprise a selected length of suitable strength fishing line, such as single-threaded Nylon line. The use of at least two elongated elements as the lace 14 provides for redundancy so that in case one of the two strings should break the other string will remain intact until the end of an event or activity in which the wearer is participating. The lace 14 may comprise a length of wire or other similar material.

As stated above, the middle portion 16 of the lace 14 preferably extends in criss-cross relationship about and between the anchor elements 12*a–d*, rather than being threaded directly through the lace eyelets E as in the case of a traditional lace. Also, as mentioned above, the pair of opposite end portions 18*a,b* of the lace 14 extend from anchor elements 12*a–d* near the rear or top end 32*b* of the tongue T. While the lace 14 is preferably routed between the elements 12*a–d* in criss-cross fashion, it may be routed therebetween in other lacing arrangements known in the art.

The smooth surface of the lace 14 substantially reduces the friction between the lace 14 and the anchor elements 12*a–d* when the wearer pulls on the opposite end portions 18*a,b* of the lace 14 to tighten the upper body B of the shoe S over the wearer's foot. The sections of the lace 14 extending between opposing anchor elements 12*a–d* are placed uniformly under the same tension causing them to concurrently shorten merely by pulling rearwardly only on the opposite end portions 18*a,b* of the lace 14.

There is minimal friction between the anchor elements 12*a–d* and the exterior surface of the lace 14 as compared to the friction between the traditional lace and lace eyelets. Thus, pulling on the opposite end portions 18*a,b* of the lace 14 shortens the middle portion 16 of the lace 14 without the need of the wearer to adjust individual sections of the lace 14 to achieve a secure fit. Also, the slippery or low friction surface of the lace 14 permits the lace 14 to constantly self-adjust and conform to the shape of the foot during movement of the wearer's foot.

Use of the first form of the present invention is as follows. First, the wearer (or shoe manufacturer) user places anchor elements 12*a–d* in each of the eyelets E of his shoe S. The wearer then threads a lace 14 through the anchor elements 12*a–d*.

The wearer disconnects the tabs 52*a,b* from the connecting segment 50 on the shoe S, thereby allowing for loosening of the lace 14. Once disconnected, the wearer loosens the lace 14 and places the shoe on this foot.

The wearer then tightens the lace 14 to secure the shoe around his foot. The wearer simply pulls on the end portions 18*a,b* of the lace 14 by pulling the tabs 52*a,b* rearwardly, as illustrated by arrow 56 in FIG. 10. This movement causes a shortening of the length of lace 14 which traverses the anchor elements 12*a–d*, thus pulling the opposite rows of anchor elements 12 toward one another and tightening the upper body B of the shoe S.

The wearer then fastens the tabs 52*a,b* to the connecting segment 50 on the rear R of the shoe S by pressing the interengaging hook and loop connector material on these elements into engagement with one another, as illustrated by the arrow 58 in FIG. 10. Once engaged, the interengaging hook and loop material prevents the opposite end portions 18*a,b* of the lace 14 from decreasing in length, which would result in the rows of anchor elements 12 to move away from one another and a loosening of the upper body B of the shoe S.

Preferably, the connecting segment 50 is of substantially greater length than each of the tabs 52*a,b* so that the wearer may engage it at various positions along the first patch 50 depending upon the degree of tightness of the lacing system 10 desired by the wearer of the shoe S.

Figure 13:
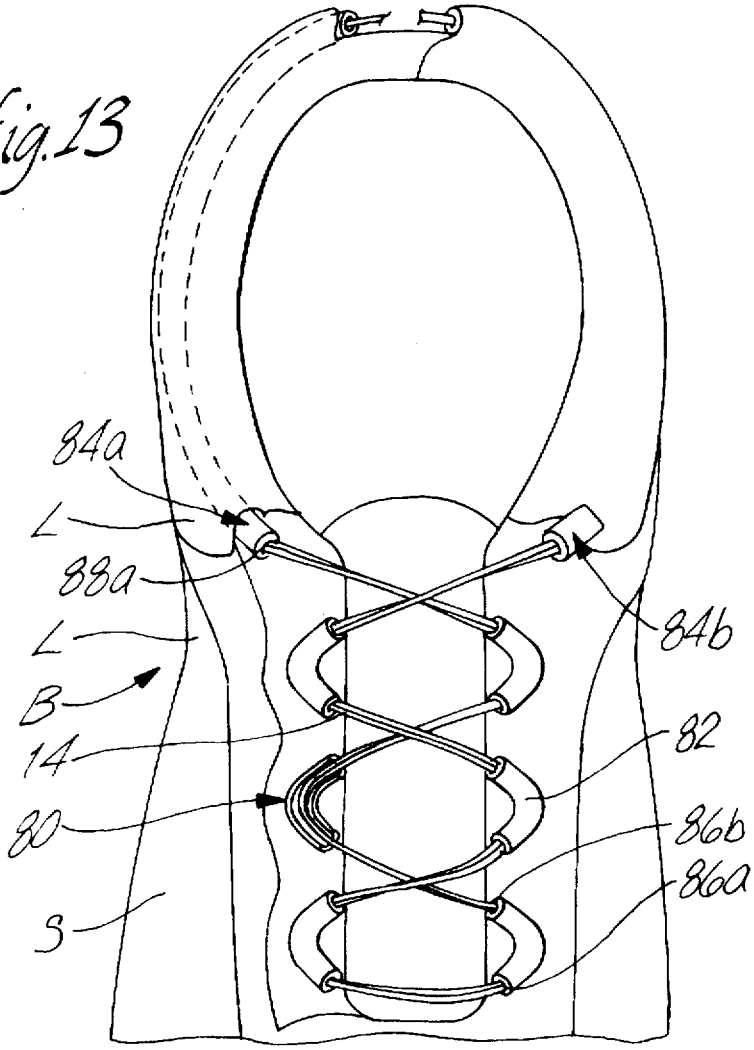
FIG. 13 is a top plan view of a shoe with a second embodiment of the shoe lacing system of the present invention having low friction tubular guide means.
Figure 14:
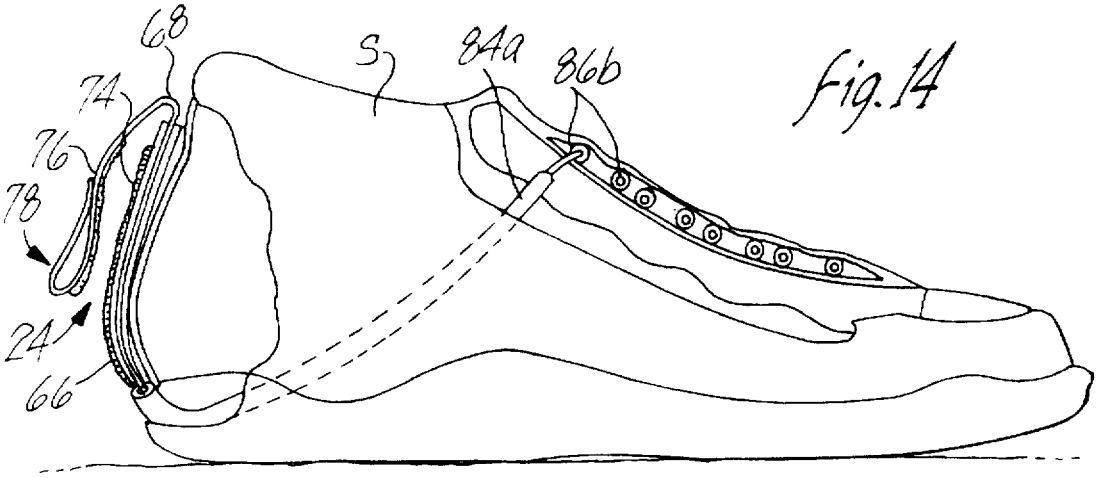
FIG. 14 is a side elevational view in partial cross-section showing a second embodiment of the releasable fastening arrangement of the lacing system of the present invention.
Figure 17:
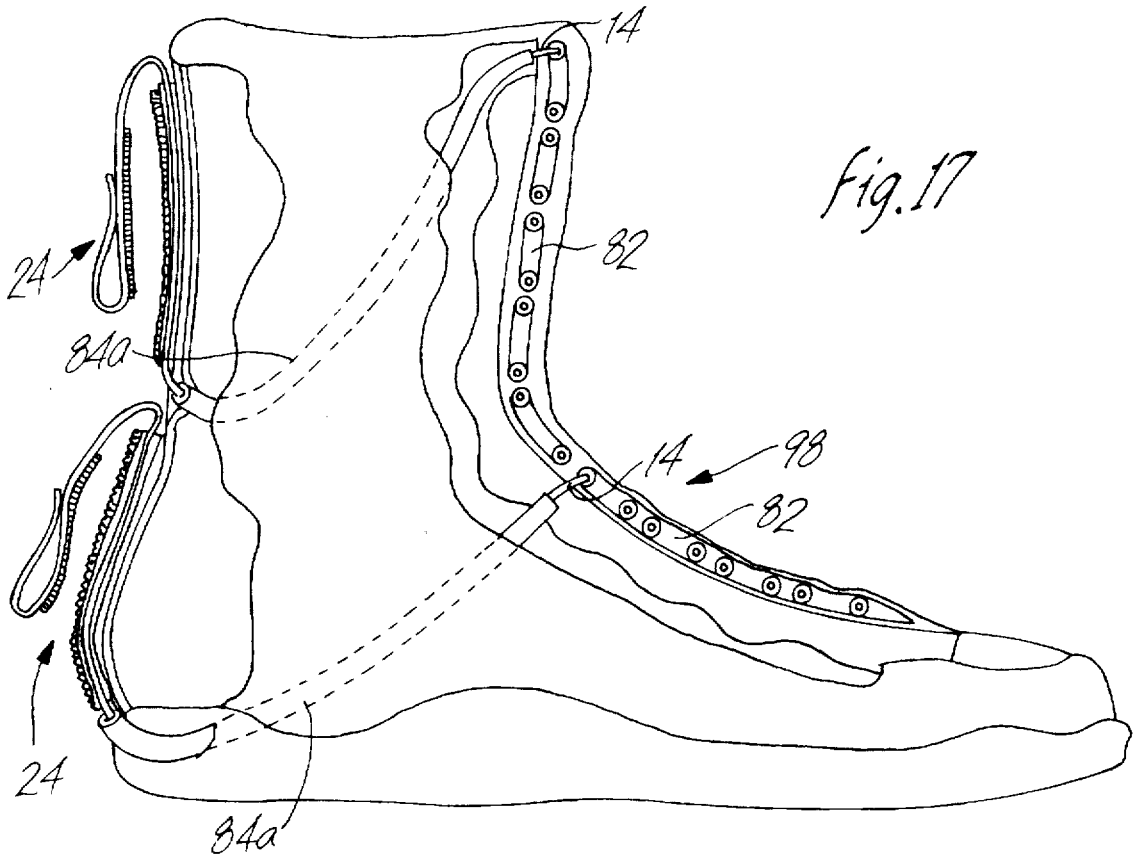
FIG. 17 is a boot illustrated with the second embodiment of the shoe lacing system of the present invention having the low friction tubular guide means illustrated in FIG. 13.
Figure 18:
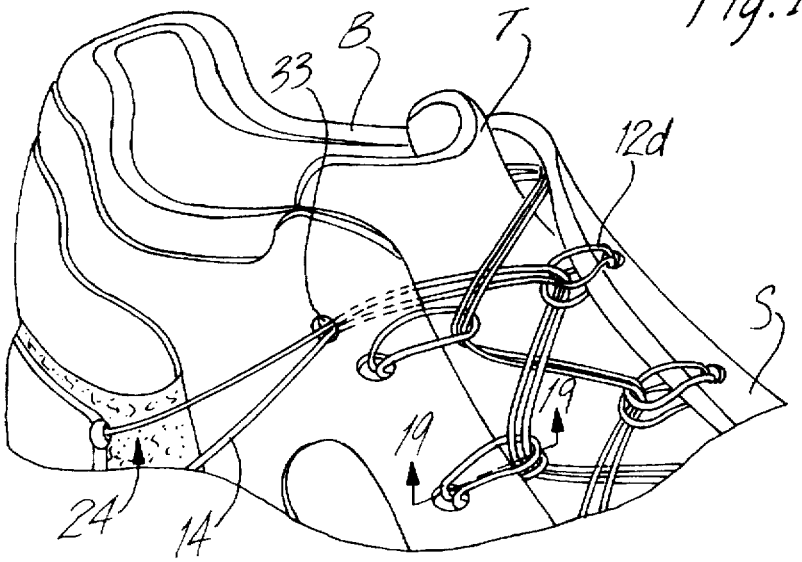
FIG. 18 is a partial perspective view of a shoe with a fourth embodiment anchor element.
Figure 19:
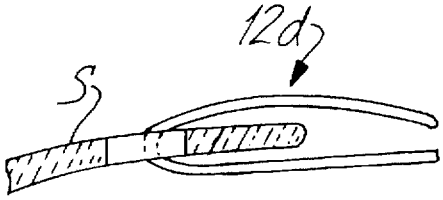
FIG. 19 is a cross-sectional side view of an anchor element illustrated in FIG. 18 taken along line 19—19 of FIG. 18.
Figure 20:
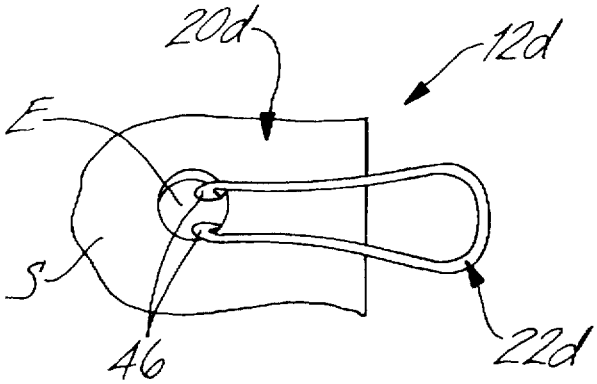
FIG. 20 is a top view of the anchor element illustrated in FIG. 19.
Figure 21:
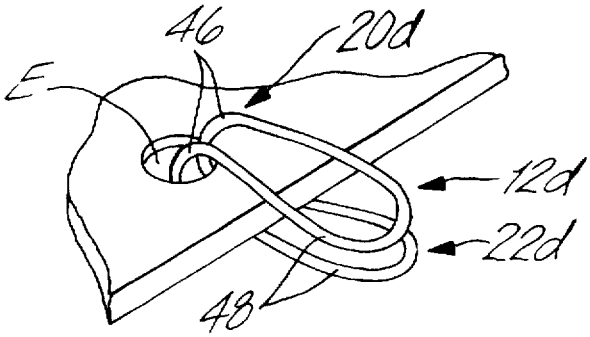
FIG. 21 is a perspective view of the anchor element illustrated in FIG. 19.

FIGS. 13, 14 and 17 illustrate a second form of the present invention, where the anchor elements are in the form of lace guide means 80.

The guide means 80 preferably comprise short arcuate-shaped tubular guide segments 82 that are mounted between inner and outer layers L on the upper body B of the shoe S in parallel rows on opposite sides of the tongue T of the shoe S. Each guide segment 82 comprises a tubular body having a first open end 86*a*, a second open end 86*b*, and a passage therebetween. The segments 82 are mounted on the shoe S so that their open ends 86*a,b* are accessible to the wearer, as illustrated in Figure B.

The segments 82 preferably replace the anchor elements, and as illustrated, eliminate the need for eyelets E. It is possible, however, to mount the segments 82 in alignment with the eyelets E which are present in an already manufactured shoe.

Preferably, the lace 14 is threaded through and extends in criss-cross relationship between the tubular guide segments 82.

The guide means 80 preferably also includes a pair of curved tubular guides 84*a,b* mounted on opposite sides of the upper body B of the shoe S. Like the tubular guide segments 82, the curved tubular guides 84*a,b* are preferably tubular members having a first open end 88*a*, second end 88*b*, and a passage therebetween. Preferably, the first end 88*a* of each tubular guide 84*a,b* is located outside of the upper body B of the shoe S adjacent to and rearwardly from respective rear ends of the rows of tubular guide segments 82, and extends therefrom in between inner and outer layers of the body B of the shoe S, and then passes through a slit in the outer surface of the shoe to its second end 88*b* located on the outer surface of the shoe S at the rear end R thereof.

The tubular guide segments 82 and curved tubular guides 84 can be attached in any suitable known manner to the exterior surface or inner walls of the opposite sides of the upper body B of the shoe S. The opposite end portions 18*a,b* of the elongated lace 14 are threaded through respective tubular guide 84 so that their terminal ends emerge from the rear ends of the tubular guides 84 at the rear end R of the shoe S.

FIG. 17 illustrates use of this second form of the present invention on a boot 98. Here, a first system of guides and a lace are used to adjust the lower portion of the boot, and a second system of guides and a lace are used to adjust the top portion of the boot.

Figure 15:
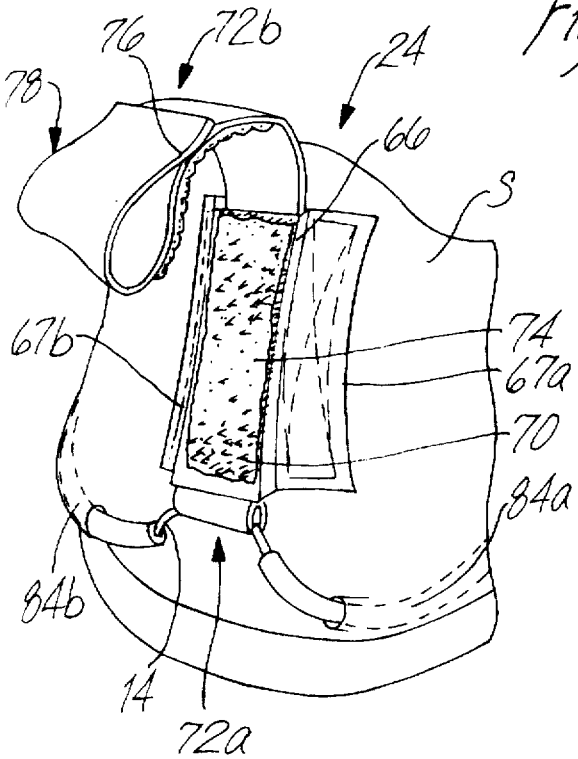
FIG. 15 is a perspective view of a second embodiment releasable fastening arrangement of the present invention.

FIGS. 13 through 15 illustrate a second embodiment of the releasable fastening means 24, which embodiment is preferably used with the embodiment of the invention illustrated in FIGS. 13–15 and 16, but which may be used with the other forms of the invention herein described. In this embodiment, the means 24 preferably comprises an anchor strip 66 and a strap 68 connected to the lace 14.

The anchor strip 66 preferably comprises a section of material secured along opposite vertical edge portions 67*a,b* thereof to the rear end R of the upper body B of the shoe S and having a central portion 70 with hook or loop fastening material secured thereto.

The strap 68 is a flexible member having a first end 72*a* and a second end 72*b*. The first end 72*a* of the strap 68 is preferably located below the anchor strip 66, which is positioned above the second ends 88*b* of the curved tubular guides 84*a,b*. The strap 68 extends under the anchor strip 66 to the second end 72*b*. The ends 18*a,b* of the lace 14 are connected to the first end 72*a* of the flexible strap 68.

A section of hook or loop material 74 is located on the outer surface of the central portion 70 of the strip 66, while a mating section of hook or loop material 76 is positioned on the inner surface of the strap 68 at the second end 72*b* thereof.

The strap 68 slidably extends upwardly between the anchor strip 66 and rear end R of the shoe S so as to be movable upwardly and downwardly relative to the anchor strip 66. Preferably, the second end 72*b* of the strap 68 includes a loop 78 for engagement by a finger of a wearer, whereby the wearer may effectuate movement of the strap 68 with respect to the strip 66.

To quickly and easily secure the upper body B of the shoe S over the wearer's foot, the wearer inserts a finger through the loop 78 and pulls upward on the flexible strap 68. First, this movement causes the strap 68 to be disengaged from the strip 66. Further upward movement causes the lace 14 to be pulled upwardly, shortening the length of the middle portion 16 of the lace 14 and thereby pulling the opposite rows of tubular guide segments 82 toward one another and tightening the upper body B of the shoe S. Then, the wearer presses the hook or loop material 76 on the strap 68 against the mating material 74 on the strip 66 to prevent movement of the flexible strap 68, and thus loosening of the lace 14.

Figure 16:
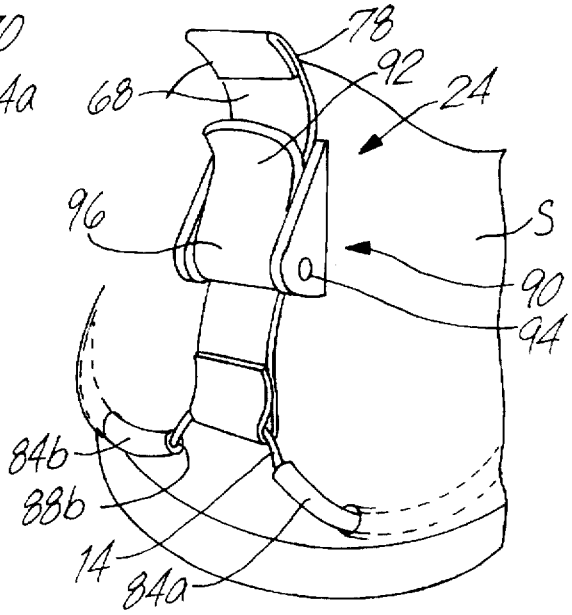
FIG. 16 is a perspective view of a third embodiment of the releasable fastening arrangement of a lacing system of the present invention.

FIG. 16 illustrates a variation of the above-referenced means for releasably fastening 24, in which the strap 68 is secured by means of a clamp 90. Preferably, the clamp 90 comprises a lever arm 92 and a base 94 mounted on the rear end R of the upper body B of the shoe S above the second ends 88*b* of the curved tubular guides 84*a,b*.

As in the arrangement described above, a flexible strap 68 is connected at its lower end to the ends 18*a,b* of the lace 14 and preferably includes a loop 78 at the first end thereof. The strap 68 passes between the outwardly facing surface of the base 94 of the clamp 90 and the lever arm 92 which is actuatable between a clamped condition and an unclamped condition.

In the position illustrated in FIG. 16, the lever arm 92 extends upwardly, and leaves a passage for the strap 68 between it and the base 92. When a wearer pivots the arm 92 downwardly, a bulge 96 on the arm rotates in the direction of the strap 68, pressing it firmly against base 92, preventing movement of the strap 68.

Using this form of the invention, a wearer actuates the clamp 90 to its unclamped condition and inserts a finger through the loop 78 and pulls upward on the strap 68. This shortens the length of the middle portion 16 of the lace 14 thereby pulling the opposite rows of tubular guide segments 82 toward one another and tightening the upper body B of the shoe S. Then, the wearer actuates the clamp 90 to its clamped condition to hold the strap 68 in a fixed position. This prevents the strap 68 from moving downward and thereby allowing the length of the middle portion 16 of the lace 14 from increasing so that the rows of tubular guide segments 82 can move away from one another and loosen the upper body B of the shoe S.

While several specific embodiments of the releasable fastening means 24 are described and illustrated, many others may be used in the present invention. For example, snaps, hooks or other clamping means may be used for adjusting the position of the ends 18*a,b* of the lace 14.

The above-referenced shoe lacing system has many advantages over the prior art. As detailed above, one of the problems associated with using present lacing systems is the time needed to adjust the lace along the eyelets and then tie its free ends. While it is always undesirable to expend time to tie one's shoes, the time necessary is critical in some instances. For example, in many athletic events, a competitor must change shoes one or more times during the event. The time necessary to lace and unlace the shoes to take them on and off increases the total time of the competitor in finishing the event.

Using the system of the present invention, a wearer can quickly lace and unlace his shoes. In particular, the wearer only need use the releasable fastening means of the invention to secure and unsecure the lace.

Moreover, because the lace moves smoothly through the guides/or anchor elements, the wearer does not need to adjust individual sections of the lace between eyelets. Instead, movement of the releasably fastening means effectuates movement of the lace along its entire length.

Another advantage of the present invention is that it facilitates better shoe fit. In present lacing systems, the distance of the lace travels between eyelets may vary long the shoe because of variations in the width of the users foot. Because the lace often binds at each eyelet, the user has a difficult time adjusting the lace distance between individual eyelets. Thus, the lace may cause the shoe to be too tight in some areas, or too loose in others.

In the system of the present invention, the lace moves freely through the guides/anchor elements. Thus, the lace has uniform tension along its length, causing the shoe to be tightened around the wearers foot evenly along its length.

Another advantage of the present invention relates to the fact that the lace is not tied across the top of the wearer's foot. Using traditional laces, the wearer must pull the ends of the laces other across stretch them towards each other across the top of his foot, and then tie them in a knot to prevent the loosening of the lace. This often results in pinching or excessive pressure across the top of the users foot at the ankle.

In the lacing system of the present invention, each end of the lace traverses from the last row of anchor elements to the back of each shoe on opposite sides of the shoe. In other words, the ends of the lace do not cross one another on the top of the wearer's foot, eliminating the pinching and pressure associated with use of common lacing systems.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A lacing system for use with a shoe having an upper body and a tongue comprising:

a plurality of anchor elements adapted to be disposed on the body on either side of the tongue, each anchor element including a guide member with an inside surface;

a substantially inelastic flexible line adapted to be threaded through said anchor element guide members, said line having an outer surface adapted to pass over the inside surface of each anchor element with low friction, the line having two ends;

a pair of tabs each substantially larger than the cross-sectional dimension of the line;

means for securing each of the line ends to a tab; and means for releasably fastening each tab to the shoe, whereby a wearer pulls the tabs to draw the line through the anchor elements to tighten the shoe onto their foot and releasably fastens the tabs to the shoe, said low friction between the line and anchors maintaining a substantially uniform tension in the line throughout the lacing system.

2. The lacing system of claim 1 wherein said releasable fastening means is located at a rear portion of said shoe.

3. The lacing system of claim 1 wherein said releasable fastening means comprises a first segment of hook or loop material secured to the shoe and a pair of tabs, each tab connected to one of said ends of said lace, each tab having a segment of hook or loop material positioned thereon for mating engagement with said first segment of material on said shoe.

4. The lacing system of claim 1 wherein each anchor inside surface is arranged transverse to the direction the line is drawn through said anchors.

5. The lacing system of claim 1 wherein the shoe upper body includes a plurality of eyelets, each anchor including means for attaching the anchor to the shoe at an eyelet.

6. The lacing system of claim 1 wherein each tab is approximately planar having a width dimension substantially larger than the cross-sectional dimension of the line.

7. The lacing system of claim 1 including a pair of lines threaded through said anchor element guide members wherein each tab is secured to the ends of each line pair.

8. The lacing system of claim 5 wherein the means for attaching the anchor includes a hook adapted to hook each anchor into an eyelet.

9. The lacing system of claim 6 wherein the releasable fastening means includes a hook and pile connection means between the tabs and the shoe.

10. The lacing system of claim 9 wherein each tab is substantially rectangular.

11. The lacing system of claim 9 wherein the shoe includes a segment at the rear of the shoe defining one of the hook and pile components of the fastening means.

12. The lacing system of claim 7 wherein each tab is substantially rectangular.

13. The lacing system of claim 7 wherein the line pair ends are attached at spaced locations on the tab.

14. The lacing system of claim 13 wherein the line pair ends are attached at spaced locations of the tab sufficient to receive a finger therebetween.

15. A lacing system for use with a shoe having an upper body, eyelets fashioned in the upper body and a tongue comprising:

a plurality of anchor elements adapted to be disposed on the body on either side of the tongue, each anchor member including a hook portion adapted to hook through an eyelet and a guide member with an inside surface;

a substantially inelastic flexible line adapted to be threaded through said anchor element guide members, said line having an outer surface adapted to pass over the inside surface of each anchor element with low friction, the line having two ends;

a pair of tabs each substantially larger than the cross-sectional dimension of the line;

means for securing each of the line ends to a tab; and means for releasably fastening each tab to the shoe, whereby a wearer pulls the tabs to draw the line through the anchor elements to tighten the shoe onto their foot and releasably fastens the tabs to the shoe, said low friction between the line and anchors maintaining substantially uniform tension of the line throughout the lacing system.

16. A lacing system for use with a shoe having an upper body and a tongue comprising:

a plurality of anchor elements adapted to be disposed on the body on either side of the tongue, each anchor member including a hook portion adapted to hook through an eyelet and a guide member with an inside surface;

a pair of substantially inelastic flexible lines adapted to be threaded through said anchor element guide members, each line having an outer surface adapted to pass over the inside surface of each anchor element with low friction, the line pair defining two ends;

a pair of tabs each substantially larger than the cross-sectional dimension of the line;

means for securing the ends of each line pair to a tab; and means for releasably fastening each tab to the shoe, whereby a wearer pulls the tabs to draw the lines through the anchor elements to tighten the shoe onto their foot and releasably fastens the tabs to the shoe, said low friction between the line and anchors maintaining substantially uniform tension of the lines throughout the lacing system.

17. The lacing system of claim 16 wherein the shoe includes eyelets on the upper body, each anchor element including a hook portion adapted to be received by an eyelet to secure the anchor to the shoe.

18. A lacing system for use with a shoe having an upper body and a tongue comprising:

a plurality of anchor elements adapted to be disposed on the body on either side of the tongue, each anchor element including a guide member with an inside surface;

a substantially inelastic flexible line adapted to be threaded through said anchor element guide members, said line having an outer surface adapted to pass over the inside surface of each anchor element with low friction, the line having two ends adapted to be attached to the shoe, whereby a wearer pulls the ends to draw the line through the anchor elements to tighten the shoe onto their foot, said low friction between the line and anchors maintaining a substantially uniform tension in the line throughout the lacing system.

* * * * *